US006893218B2

(12) United States Patent
Ito

(10) Patent No.: US 6,893,218 B2
(45) Date of Patent: May 17, 2005

(54) CENTRIFUGAL BLOWER UNIT

(75) Inventor: Koji Ito, Nagoya (JP)

(73) Assignee: Denso Corporation, Kariya (JP)

( * ) Notice: Subject to any disclaimer, the term of this patent is extended or adjusted under 35 U.S.C. 154(b) by 1 day.

(21) Appl. No.: 10/408,375

(22) Filed: Apr. 7, 2003

(65) Prior Publication Data

US 2003/0190230 A1 Oct. 9, 2003

(30) Foreign Application Priority Data

Apr. 9, 2002 (JP) ..... 2002-106518

(51) Int. Cl.[7] ..... F04D 29/54

(52) U.S. Cl. ..... 415/198.1; 415/204; 415/206; 416/186 R; 416/200 R; 416/201 A

(58) Field of Search ..... 415/151, 156, 415/198.1, 204, 206; 416/198 R, 200 R, 201 A, 203, 175, 186 R, 187

(56) References Cited

U.S. PATENT DOCUMENTS 3,081,019 A * 3/1963 Freevol ..... 415/198.1

6,142,864 A * 11/2000 Uemura et al. ..... 454/121

FOREIGN PATENT DOCUMENTS

JP 2000-203235 7/2000

* cited by examiner

*Primary Examiner*—Edward K. Look
*Assistant Examiner*—Dwayne J. White
(74) *Attorney, Agent, or Firm*—Harness, Dickey & Pierce, PLC

(57) ABSTRACT

In a centrifugal blower unit for an inside and outside air double-layer flow type vehicular air conditioner, a centrifugal fan includes a first fan and a second fan. The first fan and the second fan have plural first blades and second blades arranged about a rotation axis, respectively. A separation wall is provided between the first blades and the second blades. The separation wall restricts mixture of air blown by the first fan and air blown by the second fan. Also, it restricts the air blown by the first fan striking against an end of a divider, thereby suppressing noise due to turbulent air flow.

11 Claims, 3 Drawing Sheets

CENTRIFUGAL BLOWER UNIT

CROSS REFERENCE TO RELATED APPLICATION

This application is based on Japanese Patent Application No. 2002-106518 filed on Apr. 9, 2002, the disclosure of which is incorporated herein by reference.

FIELD OF THE INVENTION

The present invention relates to a centrifugal blower unit used for an inside and outside air double-layered flow type vehicular air conditioner, which sucks inside and outside air separately at the same time.

BACKGROUND OF THE INVENTION

JP-A-2000-203235 discloses a centrifugal blower unit for an inside and outside air double-layered flow type vehicular air conditioner. In the centrifugal blower unit, a divider is provided to restrict mixture of two kinds of air blown by a centrifugal fan.

The centrifugal fan generally sucks air in an axial direction and blows it in a radially outside direction. As shown in FIG. 5, air that flows above a divider 103 and enters between blades 101 partially blows downward under a divider 102, as denoted by an arrow, by its inertial force while changing its flow direction. As a result, air separability is lessened. Further, the air, which blows downwardly through the blades 101, is likely to strike against an end of the divider 102 and cause turbulent air flow, resulting in noise.

SUMMARY OF THE INVENTION

The present invention is made in view of the above disadvantages, and it is an object of the present invention to provide a centrifugal blower unit for an inside and outside air double-layered flow type vehicular air conditioner with improved air separability.

According to the present invention, a centrifugal blower unit includes a centrifugal fan having a first fan and a second fan, a scroll casing housing the centrifugal fan and a driving device for rotating the centrifugal fan. The first fan and the second fan have a plurality of first blades and second blades arranged about a rotation axis of the fan, respectively. The centrifugal fan draws air in an axial direction and blows it in a radially outside direction. The scroll casing forms a spiral air passage into which air blown by the centrifugal fan collects. A divider is provided in the scroll casing to restrict mixture of air blown by the first fan and the second fan. The first blades are offset from the second blades in a direction parallel to the rotation axis. A separation wall is provided between the first blades and the second blades, thereby restricting air flowing from the first blades toward the second blades and flowing from the second blades toward the first blades.

Accordingly, it is less likely that air blown by the first fan and air blown by the second air will mix. Further, it restricts air blown by the first fan striking against an end of the divider, thereby reducing noise due to turbulent air flow.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENTS

Figure 1:
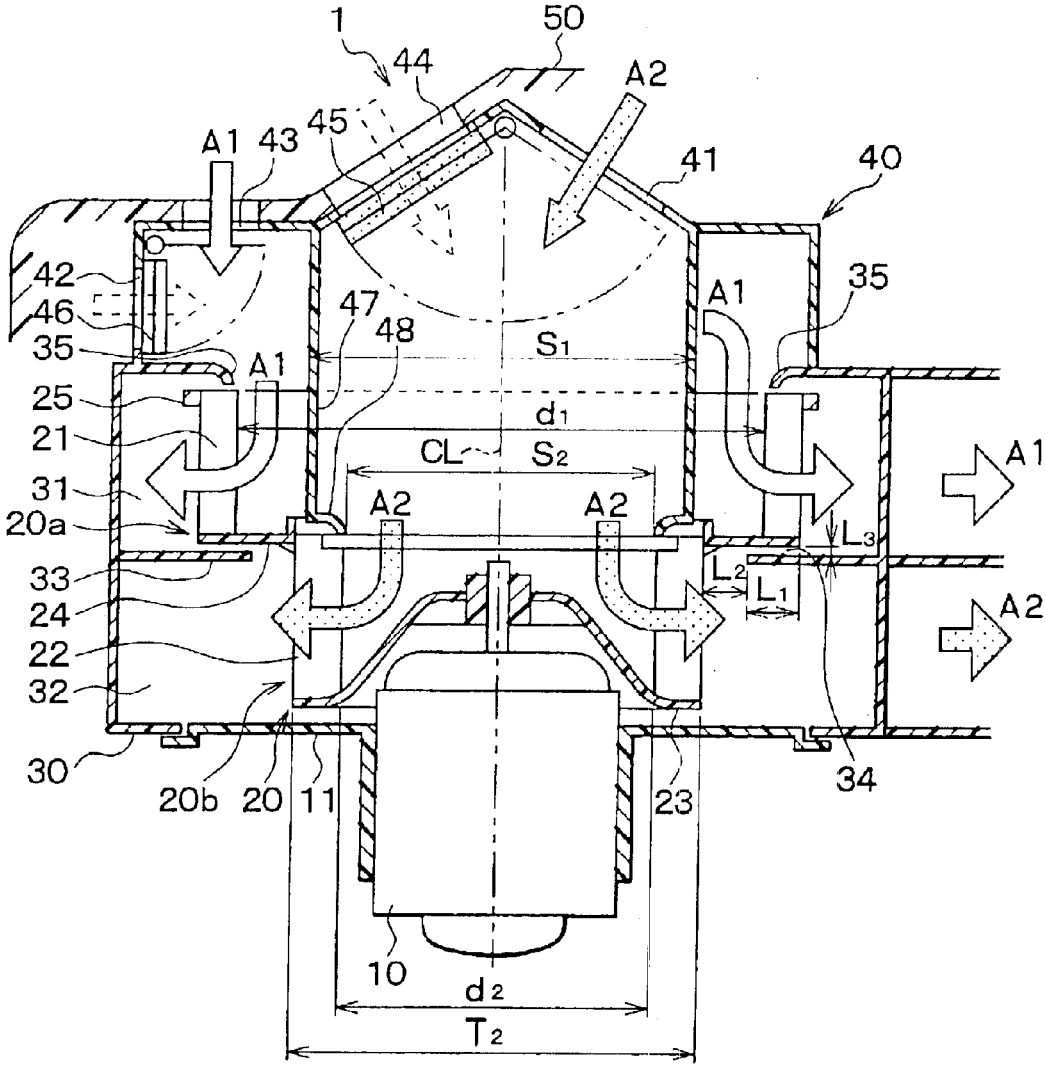
FIG. 1 is a schematic cross-sectional view of a centrifugal blower unit according to the first embodiment of the present invention.

Referring to FIG. 1, a centrifugal blower unit 1 is used for an inside and outside air double-layered flow type vehicular air conditioner that draws inside air and outside air separately at the same time. An air conditioner casing (not shown) is connected to an air downstream position of the centrifugal blower unit 1. Devices for conditioning air temperature, such as an evaporator, heater core and air mixing doors, are provided in the air conditioner casing.

The centrifugal blower unit 1 is integrated with an inside and outside air switching unit 40 (described later) by a mechanical fastening device such as bolts and screws. In FIG. 1, an electric motor 10 is a driving device for rotating a centrifugal fan 20. The centrifugal fan 20 is an impeller including a first fan 20*a* and a second fan 20*b*. The first fan 20*a* includes a plurality of first blades 21 arranged about a rotation axis CL. The first fan 20*a* draws air in an axial direction and blows it in a radially outside direction. The second fan 20*b* includes a plurality of second blades 22 arranged about the rotation axis CL at a position offset from the first blades 21 in a direction parallel to the rotation axis CL. The second fan 20*b* draws air in the axial direction and blows it in the radially outside direction.

The motor 10 is fixed to a scroll casing 30 (described later) through a flange 11 that is provided in an outer periphery of a motor housing. A hub 23 is a main plate and transmits a rotation force of the motor 10 to the second fan 20*b*. A separation wall or second side plate 24 is located at ends of the second blades 22 on a side opposite to the hub 23 in the axial direction. The second side plate 24 transmits the rotation force transmitted to the second fan 20*b* to the first fan 20*a*. The second side plate 24 is formed into an annular plate. The second side plate 24 reinforces the second fan 20*b* as a reinforcement member.

A first side plate 25 is located at the ends of the first blades 21 on a side opposite to the second side plate 24 in the axial direction. The first side plate 25 has an annular shape and reinforces the first fan 20*a* as a reinforcement member.

An inside diameter d1 of the first fan 20*a* is different from an inside diameter d2 of the second fan 20*b*. As shown in FIG. 1, the inside diameter d1 of the first fan 20*a*, which is on an air intake side of the centrifugal fan 20, that is, on a side opposite to the motor 10, is larger than an inside diameter d2 of the second fan 20*b*.

The first fan 20*a* and the second fan 20*b* are integrally molded of resin. Here, the centrifugal fan 20 is molded such that a draft direction is in consistent with the longitudinal direction of the rotation axis CL.

The scroll casing 30 houses the centrifugal fan 20 and forms an air passage into which air blown by the fan 20 collects. A divider 33 is provided in the air passage to divide the air passage into a first air passage 31 to which air blown by the first fan 20*a* flows and a second air passage 32 to which air blown by the second fan 20*b* flows. Thus, the divider 33 restricts mixture of the air blown by the first fan 20*a* and the air blown by the second fan 20*b*.

The scroll casing 30 is formed into a spiral shape around the centrifugal fan 20. Here, the air passages 31, 32 are formed such that cross-sectional areas of the air passages 31, 32 increase in a logarithmic spiral form relative to a scroll winding angle.

The divider 33 overlaps with the second side plate 24 at least at a part, when viewed in the direction along the rotation axis CL. As shown in FIG. 1, an overlapping dimension L1 is 10.0 mm. Also, there is a small gap 34 between the divider 33 and the second side plate 24. A dimension L3 of the gap 34 in the axial direction is 5.0 mm. A dimension L2 is a distance between the divider 33 and the second blades 22 in the radial direction of the fan 20 and is about 10.0 mm.

The inside and outside air switching unit 40 selects air to be introduced to the centrifugal blower unit 1. The inside and outside air switching unit 40 forms inside air intake ports 41, 42 through which inside air is introduced in, and outside air intake ports 43, 44 through which outside air is introduced in. The first inside and outside air switching door 45 opens and closes the inside air intake port 41 and the outside air intake port 44. A second inside and outside air switching door 46 opens and closes the inside air intake port 42 and the outside air intake port 43.

A separating cylinder 47 is provided in an inner periphery of the first fan 20*a* to separate a space for the air to be sucked by the first fan 20*a* from a space for the air to be sucked by the second fan 20*b*. In this embodiment, the separating cylinder 47 is integrally molded with the inside and outside air switching unit 40.

The separating cylinder 47 is disposed such that its outside diameter S1 is substantially the same as an outside diameter T2 of the second fan 20*b*. Also, an inside diameter S2 of the separating cylinder 47 at an axial end adjacent to the second fan 20*b* is substantially the same as the inside diameter d2 of the second fan 20*b*.

The axial end of the separating cylinder 47 adjacent to the second fan 20*b* is smoothly curved into a bell shape and provides a bell-mouth 48. Similarly, an opening edge of the scroll casing 30, which defines an opening adjacent to the first fan 20*a*, is smoothly curved, thereby providing a bell mouth 35. A dash panel 50 is a separation wall for separating a passenger compartment from an engine compartment.

Next, effects and advantages of the embodiment will be described.

Air sucked in the inside and outside air switching unit 40 is divided into the air (first air A1) to be sucked by the first fan 20*a* and the air (second air A2) to be sucked by the second fan 20*b* by the separating cylinder 47.

The first air A1 flows toward and along the second side plate 24 by its inertial force and blows into the first air passage 31. Since the second side plate 24 is located between the first blades 21 and the second blades 22, the second side plate 24 restricts the first air A1 flowing from the first blades 21 toward the second blades 22, thereby functioning as a separation wall. Therefore, it is less likely that the first air A1 will flow into the second air passage 32.

The second air A2 flows toward and along the hub 23 by its inertial force and blows into the second air passage 32. Therefore, it is less likely that the second air A2 will flow into the first air passage 31 through the gap 34.

Accordingly, the first air A1 and the second air A2 are introduced properly toward the air conditioner casing without mixing together. Further, the first air A1 is restricted to flow toward the second air passage 32. Therefore, noise due to turbulent flow of the first air A1 is decreased.

Since the inside diameter d1 of the first fan 20*a* is different from the inside diameter d2 of the second fan 20*b*, the second side plate 24 is located as a wall extending substantially perpendicular to the rotation axis CL between the first blades 20*a* and the second blades 20*b*. Therefore, the first air A1 flowing in the direction substantially parallel to the rotation axis CL with its inertial force is blocked by the second side plate 24. That is, the flow of the first air A1 substantially parallel to the rotation axis is blocked and directed in the radial direction by the second side plate 24. Therefore, the second side plate 24 acts as a blocking and guiding plate.

Accordingly, the flow of the first air A1 along the separating cylinder 47 can be directed toward the first blades 21 by the second side plate 24. Therefore, it is less likely that the first air A1 will flow toward the second air passage 32. It reduces noise due to turbulent flow of the first air A1.

The second side plate 24 connects with the second blades 22 in the radially inside of the first blades 21. Also, the bell mouth 48 is located adjacent to that connecting portion. However, because the first air A1 is blown in the radially outside direction by a centrifugal force, it is less likely that the first air A1 will flow into the second fan 20*b* through the bell mouth 48.

Further, since the second side wall 24 partially overlaps with the divider 33, it is less likely that the air blown by the first fan 20*a* will mix with the air blown by the second fan 20*b*.

The second embodiment of the present invention will be described with reference to FIG. 2. In the second embodiment, the inside diameter d1 of the first fan 20*a* is same as the inside diameter d2 of the second fan 20*b*.

Also in this embodiment, the second side plate 24 acts as the separation wall. Thus, it restricts mixture of the first air A1 and the second air A2. Because the second side plate 24 restricts that the first air A1 flows toward the second air passage 32, the flow of the first air A1 is not disturbed. Therefore, noise due to turbulent flow of the first air A1 decreases.

Further, the divider 33 has a step at a portion that overlaps with the second side plate 24 when viewed along the direction parallel to the rotation axis CL. Therefore, the gap 34 is formed into a crank like a maze. It restricts the second air A2 flowing into the first air passage 31 and the first air A1 flowing into the second air passage 32. A ring member 23*a* is provided radially outside of the second fan 20*b*. It acts as a reinforcement member to reinforce the second fan 20*b* as a hoop.

Figure 2:
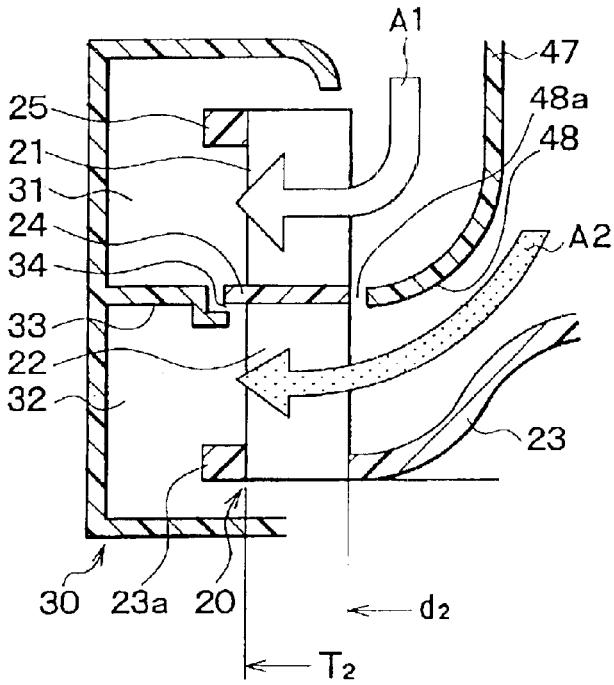
FIG. 2 is a cross-sectional view of a part of a centrifugal blower unit according to the second embodiment of the present invention.

As shown in FIG. 2, there is a small gap 48*a* between an end of the bell mouth 48 and the second side plate 24. However, because the second side plate 24 is provided adjacent to the end of the bell moth 48 in the radial direction, the first air A1 can directed toward the first blades 21 by the curved shape of the bell mouth 48 and the centrifugal force. Therefore, the small gap 48*a* have little effect to air separability.

Figure 3:
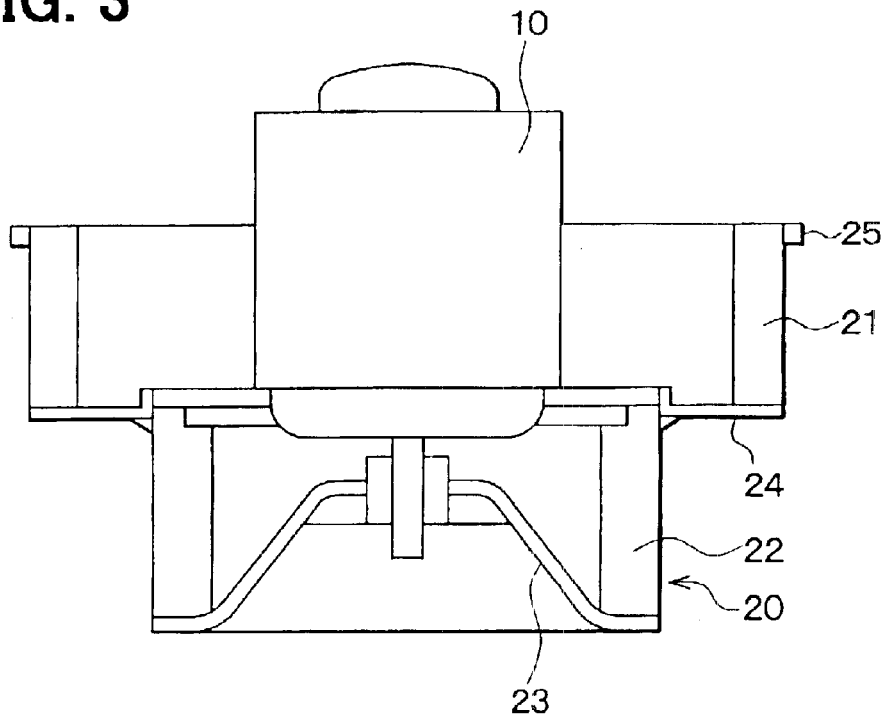
FIG. 3 is a schematic side view of a centrifugal blower unit according to another embodiment of the present invention.

In the first and the second embodiments, the motor 10 is arranged in an outside of the centrifugal fan 20. However, the motor 10 can be arranged in an inside of the centrifugal fan 20, as shown in FIG. 3.

In the first and the second embodiments, air is introduced in the first and the second fan 20*a*, 20*b* in the same direction. However, it can be modified. For example, the air for the first fan 20*a* can be introduced from a side opposite to the motor 10 and the air for the second fan 20*b* can be introduced from a side adjacent to the motor 10. In this case, the second side plate 24 is formed into a disc shape to divide between the first fan 20*a* and the second fan 20*b*.

Figure 4:
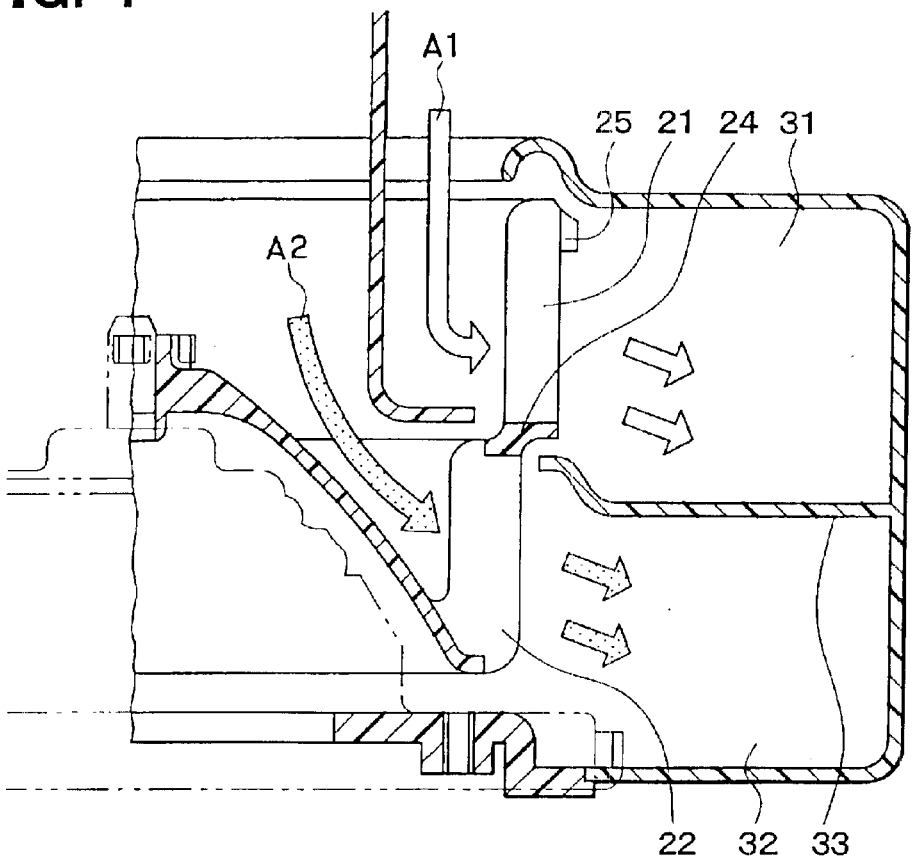
FIG. 4 is a schematic cross-sectional view of a part of a centrifugal blower unit according to another embodiment of the present invention.
Figure 5:
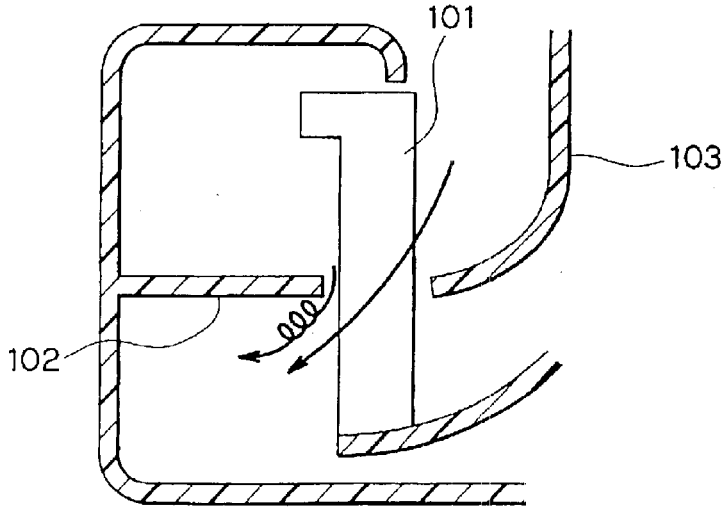
FIG. 5 RELATED ART
FIG. 5 is a schematic cross-sectional view of a part of a centrifugal blower unit of a related art.

Further, as shown in FIG. 4, a difference between the inside diameter d1 of the first fan 20*a* and the inside diameter d2 of the second fan 20*b* can be reduced as compared with that of the first embodiment.

The present invention should not be limited to the disclosed embodiments, but may be implemented in other ways without departing from the spirit of the invention.

What is claimed is:

1. A centrifugal blower unit for an inside and outside air double-layered flow type vehicular air conditioner, the centrifugal blower unit comprising:

a centrifugal fan including:

a first fan having a plurality of first blades arranged about a rotation axis for blowing air radially outward; and a second fan having a plurality of second blades arranged about the rotation axis for blowing air radially outward, wherein the second blades are offset from the first blades in a direction parallel to the rotation axis;

a separation wall provided between the first blades and the second blades to restrict air flowing from the first blades toward the second blades and from the second blades toward the first blades;

a scroll casing that houses the centrifugal fan and defines a spiral air passage into which air blown by the centrifugal fan flows;

a divider provided in the scroll casing to restrict mixture of air blown by the first fan and air blown by the second fan;

a stationary separating cylinder for separating air to be sucked into the first fan from air to be sucked into the second fan; and a driving device for rotating the centrifugal fan, wherein the first fan has an inside diameter that is larger than an inside diameter of the second fan, and wherein the first fan is arranged on one axial side of the second fan, which is opposite from the driving device.

2. The centrifugal blower unit according to claim 1, wherein the separation wall overlaps with the divider at least at a part in a radial direction with respect to the rotation axis.

3. The centrifugal blower unit according to claim 1, wherein the separating cylinder has a substantially cylindrical portion and an axial end portion and located in an inner periphery of the first fan such that the axial end portion is adjacent to the second fan, wherein the cylindrical portion has an outside diameter substantially the same as an outside diameter of the second fan, and the axial end portion has an inside diameter substantially the same as the inside diameter of the second fan.

4. The centrifugal blower unit according to claim 3, wherein the separation wall is disposed to extend in a direction substantially perpendicular to the rotation axis between the axial end portion of the separating cylinder and the divider.

5. The centrifugal blower unit according to claim 2, wherein the separation wall is disposed to extend substantially perpendicular to the rotation axis and connect between the first blades and the second blades.

6. The centrifugal blower unit according to claim 2, wherein the divider is disposed to divide the air passage into a first passage in which air blown by the first fan collects and a second passage in which air blown by the second fan collects.

7. The centrifugal blower unit according to claim 2, wherein the divider has a step at a part overlapping with the separation wall.

8. A centrifugal blower unit for an inside and outside air double-layered flow type vehicular air conditioner, the centrifugal blower unit comprising:

a centrifugal fan including:

a first fan having a plurality of first blades arranged about a rotation axis for blowing air radially outward; and a second fan having a plurality of second blades arranged about the rotation axis for blowing air radially outward, wherein the second blades are offset from the first blades in a direction parallel to the rotation axis;

a separation wall provided between the first blades and the second blades to restrict air flowing from the first blades toward the second blades and from the second blades toward the first blades;

a scroll casing that houses the centrifugal fan and defines a spiral air passage into which air blown by the centrifugal fan flows;

a divider provided in the scroll casing to restrict mixture of air blown by the first fan and air blown by the second fan;

a driving device for rotating the centrifugal fan; and a separating cylinder for separating air to be sucked into the first fan from air to be sucked into the second fan, wherein the first fan has an inside diameter that is larger than an inside diameter of the second fan, wherein the separating cylinder has a substantially cylindrical portion and an axial end portion and located in an inner periphery of the first fan such that the axial end portion is adjacent to the second fan, and wherein the cylindrical portion has an outside diameter substantially the same as an outside diameter of the second fan, and the axial end portion has an inside diameter substantially the same as the inside diameter of the second fan.

9. The centrifugal blower unit according to claim 10, wherein the separation wall is disposed to extend in a direction substantially perpendicular to the rotation axis between the axial end portion of the separating cylinder and the divider.

10. A centrifugal blower unit for an inside and outside air double-layered flow type vehicular air conditioner, the centrifugal blower unit comprising:

a centrifugal fan including:

a first fan having a plurality of first blades arranged about a rotation axis for blowing air radially outward; and a second fan having a plurality of second blades arranged about the rotation axis for blowing air radially outward, wherein the second blades are offset from the first blades in a direction parallel to the rotation axis;

a separation wall provided between the first blades and the second blades to restrict air flowing from the first blades toward the second blades and from the second blades toward the first blades;

a scroll casing that houses the centrifugal fan and defines a spiral air passage into which air blown by the centrifugal fan flows;

a divider provided in the scroll casing to restrict mixture of air blown by the first fan and air blown by the second fan; and a driving device for rotating the centrifugal fan, wherein the first fan has an inside diameter that is larger than an inside diameter of the second fan, and wherein the first fan is arranged on one axial side of the second fan, which is opposite from the driving device.

11. A centrifugal blower unit for an inside and outside air double-layered flow type vehicular air conditioner, the centrifugal blower unit comprising:

a centrifugal fan including:

a first fan having a plurality of first blades arranged about a rotation axis for blowing air radially outward; and a second fan having a plurality of second blades arranged about the rotation axis for blowing air radially outward, wherein the second blades are offset from the first blades in a direction parallel to the rotation axis;

a separation wall provided between the first blades and the second blades to restrict air flowing from the first blades toward the second blades and from the second blades toward the first blades;

a scroll casing that houses the centrifugal fan and defines a spiral air passage into which air blown by the centrifugal fan flows;

a divider provided in the scroll casing to restrict mixture of air blown by the first fan and air blown by the second fan;

a stationary separating cylinder for separating air to be sucked into the first fan from air to be sucked into the second fan; and a driving device for rotating the centrifugal fan.

* * * * *